US006860811B1

(12) United States Patent
Wilkins

(10) Patent No.: US 6,860,811 B1
(45) Date of Patent: Mar. 1, 2005

(54) METHOD FOR IMPLEMENTING A SECONDARY GAME IN A GAMING MACHINE

(75) Inventor: Kevan Wilkins, Las Vegas, NV (US)

(73) Assignee: Acres Gaming Incorporated, Las Vegas, NV (US)

( * ) Notice: Subject to any disclaimer, the term of this patent is extended or adjusted under 35 U.S.C. 154(b) by 0 days.

(21) Appl. No.: 10/120,196

(22) Filed: Apr. 9, 2002

Related U.S. Application Data

(60) Provisional application No. 60/282,703, filed on Apr. 9, 2001.

(51) Int. Cl.[7] ..... A63F 9/24
(52) U.S. Cl. ..... 463/25
(58) Field of Search ..... 463/1, 9–10, 16–20, 463/25, 26–28, 30; 273/138.1, 138.2, 139, 143 R

(56) References Cited

U.S. PATENT DOCUMENTS

| | | | |
|---|---|---|---|
| 4,837,728 A | 6/1989 | Barrie et al. | |
| 5,167,413 A | 12/1992 | Fulton | |
| 5,511,781 A | 4/1996 | Wood et al. | |
| 5,655,961 A | 8/1997 | Acres et al. | |
| 5,823,874 A | 10/1998 | Adams | |
| 5,848,932 A | 12/1998 | Adams | |
| 6,033,307 A | 3/2000 | Vancura | |
| 6,159,097 A | 12/2000 | Gura | |
| 6,159,098 A | 12/2000 | Slomiany et al. | |
| 6,190,255 B1 | 2/2001 | Thomas et al. | |
| 6,203,429 B1 | 3/2001 | Demar et al. | |
| 6,319,125 B1 | 11/2001 | Acres | |
| 6,364,767 B1 * | 4/2002 | Brossard et al. | 463/20 |

FOREIGN PATENT DOCUMENTS

| | | |
|---|---|---|
| GB | 1359 852 | 7/1974 |
| GB | 2201821 A | 9/1988 |

* cited by examiner

*Primary Examiner*—Mark Sager
(74) *Attorney, Agent, or Firm*—Marger Johnson & McCollom, PC

(57) ABSTRACT

In operation, when a special symbol appears on one of the base-game reels, the secondary game is initiated. The player is prompted to hit the spin button, which causes the lamps behind each spinner position to light in sequence until the sequence stops to point at the winning cherry. The numerical value associated with the winning cherry is the potential award in bonus credits to the player. The player can opt out and claim the award or can continue to hit the spin button thereby accruing credits in the amount associated with each cherry. But after a cherry wins—i.e., the sequence stops on it—it becomes a "bust" cherry. If the sequence stops on a bust cherry in any subsequent spin, the accrued award is lost. In that event, a consolation prize is awarded. The concept behind the invention involves player decision making and input—that is, whether the player should press his or her luck for potentially increased payout where the chance of continuing with the secondary game becomes increasingly risky as safe payout spaces are converted to bust spaces.

19 Claims, 11 Drawing Sheets

- After Bonus Accumulated in Display, Bonus Cherry Spot Turned to "Bust" Spot
- Waiting for Spin Button or Collect Button to be Pressed
- If Collect Button Pressed, Amount Accumulated in "Total Wins" Display Credited to Player Credit Meter on Base Game
- If Spin Button Pressed, go to FIG. 8.

- Bonus Symbol Obtained
- Secondary Game Initiated
- Waiting for Spin Button to be Pressed

- Spin Button Pressed
- Pointer Rotates Among Eight Different Bonus Cherries
- Pointer Stops on Selected Bonus Cherry
- Numerical Value of Bonus Cherry Accumulated in "Total Wins" Display

- After Bonus Accumulated in Display, Bonus Cherry Spot Turned to "Bust" Spot
- Waiting for Spin Button or Collect Button to be Pressed
- If Collect Button Pressed, Amount Accumulated in "Total Wins" Display Credited to Player Credit Meter on Base Game
- If Spin Button Pressed, go to FIG. 8.

- Spin Button Pressed
- Pointer Rotates Among Eight Different Bonus Cherries
- Pointer Stops on Selected Bonus Cherry
- Numerical Value of Bonus Cherry Added to Prior Amount in "Total Wins" Display

- After Bonus Accumulated in Display, Bonus Cherry Spot Turned to "Bust" Spot
- Waiting for Spin Button or Collect Button to be Pressed
- If Collect Button Pressed, Amount Accumulated in "Total Wins" Display Credited to Player Credit Meter on Base Game
- If Spin Button Pressed, go to FIG. 10.

- Spin Button Pressed
- Pointer Rotates Among Eight Different Bonus Cherries
- Pointer Stops on Selected "Bust" Cherry
- Accumulated Amount Cleared from "Total Wins" Display
- Consolation Prize Displayed (here, 3 per successful spin)

- Consolation Amount Accumulated in "Total Wins" Display Credited to Player Credit Meter on Base Game
- Player Plays Base Game

METHOD FOR IMPLEMENTING A SECONDARY GAME IN A GAMING MACHINE

CROSS-REFERENCES TO RELATED APPLICATIONS

This application claims the benefit from U.S. Provisional Patent Application No. 60/282,703 filed Apr. 9, 2001 whose contents are incorporated herein for all purposes.

BACKGROUND OF THE INVENTION

1. Field of the Invention

This invention relates generally to electronic gaming machines and more particularly to a method and apparatus for integrating a primary and secondary game within a computer network.

1. Description of the Prior Art

Casinos typically include electronic gaming machines (EGMs) such as slot machines and video poker machines. Slot machines, for example, usually include three reels that each have a plurality of symbols printed thereon. After the player applies a wager to the machine, he or she starts play by triggering a switch that starts the reels spinning. Each reel stops at a random position and thereby presents three symbols—one from each reel. Some combinations of symbols do not pay any jackpot. Others pay varying amounts according to predetermined combinations that appear in a pay table displayed on the machine and stored in the gaming machine's programmable read-on memory (PROM).

Competition for players among electronic gaming machines is tight and the industry is developing different methods for attracting and keeping players at their machines. One method for attracting players is to create linked progressive jackpot systems in which multiple gaming machines have been linked together into groups of machines that share the same bonus pool. A simple example of such a system is progressive video poker in which players play the primary poker game on one of a plurality of gaming machines grouped together on the casino floor. A coin-in counter, linked to all machines sharing the progressive pool, counts the total amount of money played in the group of machines and advances the progressive bonus pool accordingly. For instance, the casino can choose to set aside 5% of all money played on the group of video poker machines to the bonus pool. The amount of the pool is displayed on a large LED display and is incremented as money is played. This amount is awarded automatically as a bonus should a player on one of the video poker machines receive a designated winning hand such as a royal flush. After the bonus is awarded, the bonus pool is seeded with a nominal amount that is further incremented as described above.

The advantage of the progressive system is that the bonus pools from individual machines can be pooled to form larger awards that in turn attract more players. When taken to the extreme, progressive bonuses can be pooled together not only from machines in different areas of the casino, but also from different casinos in different states. More complex examples for bonusing are implemented using bonus servers over a network, such as disclosed in co-owned U.S. Pat. No. 6,319,125 (the '125 patent), which is incorporated herein by reference for all purposes. Also incorporated herein by reference for all purposes is U.S. Pat. No. 5,655,961, assigned to the Assignee of the present application (the '961 patent), which also discloses bonuses that can be implemented by bonus servers over a network.

While these linked progressive systems have been effective at drawing additional players, there is a need for gaming machines that have additional attraction features and yet are not required to be linked to other machines.

SUMMARY OF THE INVENTION

The current invention is intended to provide a novel secondary game feature that can be played in addition to the base primary game. The preferred embodiment is described in association with a slot machine, although it is understood that any base game can be used.

In operation, when a special symbol appears on one of the base-game reels, the secondary game is initiated. The player is prompted to hit the spin button, which causes the lamps behind each spinner position to light in sequence until the sequence stops to point at the winning cherry. The numerical value associated with the winning cherry is the potential award in bonus credits to the player. The player can opt out and claim the award or can continue to hit the spin button thereby accruing credits in the amount associated with each cherry. But after a cherry wins—i.e., the sequence stops on it—it becomes a "bust" cherry. If the sequence stops on a bust cherry in any subsequent spin, the accrued award is lost. In that event, a consolation prize is awarded. The concept behind the invention involves player decision making and input—that is, whether the player should press his or her luck for potentially increased payout where the chance of continuing with the secondary game becomes increasingly risky as safe payout spaces are converted to bust spaces.

In a preferred embodiment of the invention, the results of all spin phases are predetermined at the start of the bonus round in a bonus game "script". The script creates a bonus table and cross-references the number of completed phases to obtain a total bonus award that is then awarded to the player. In most instances, the last space of the bonus table includes a consolation prize payout whose amount is determined by the phase of the bonus round in which a preselected bonus space is repeated. This phase number is looked up in a consolation table to determine the amount entered in the last space of the payout table. If no repeat takes place, then the last space (phase eight) includes a final bonus amount formed by accumulating all bonus spaces (e.g. 430 credits) with a super bonus amount (e.g. 4000 credits) that is awarded to the player for successful completion of the secondary bonus game.

The foregoing and other objects, features and advantages of the invention will become more readily apparent from the following detailed description of a preferred embodiment of the invention that proceeds with reference to the accompanying drawings.

DETAILED DESCRIPTION

Although the gaming machine as described is coupled to a gaming machine network, it is understood that the gaming machine can stand alone whereby the top box secondary game is completely funded by coins or credits played within the primary game. For instance, the secondary game may be funded and thus active only when a maximum bet is made. Alternately, the secondary game may be funded in different amounts by each of the coins or credits played at the base game.

Figure 1:
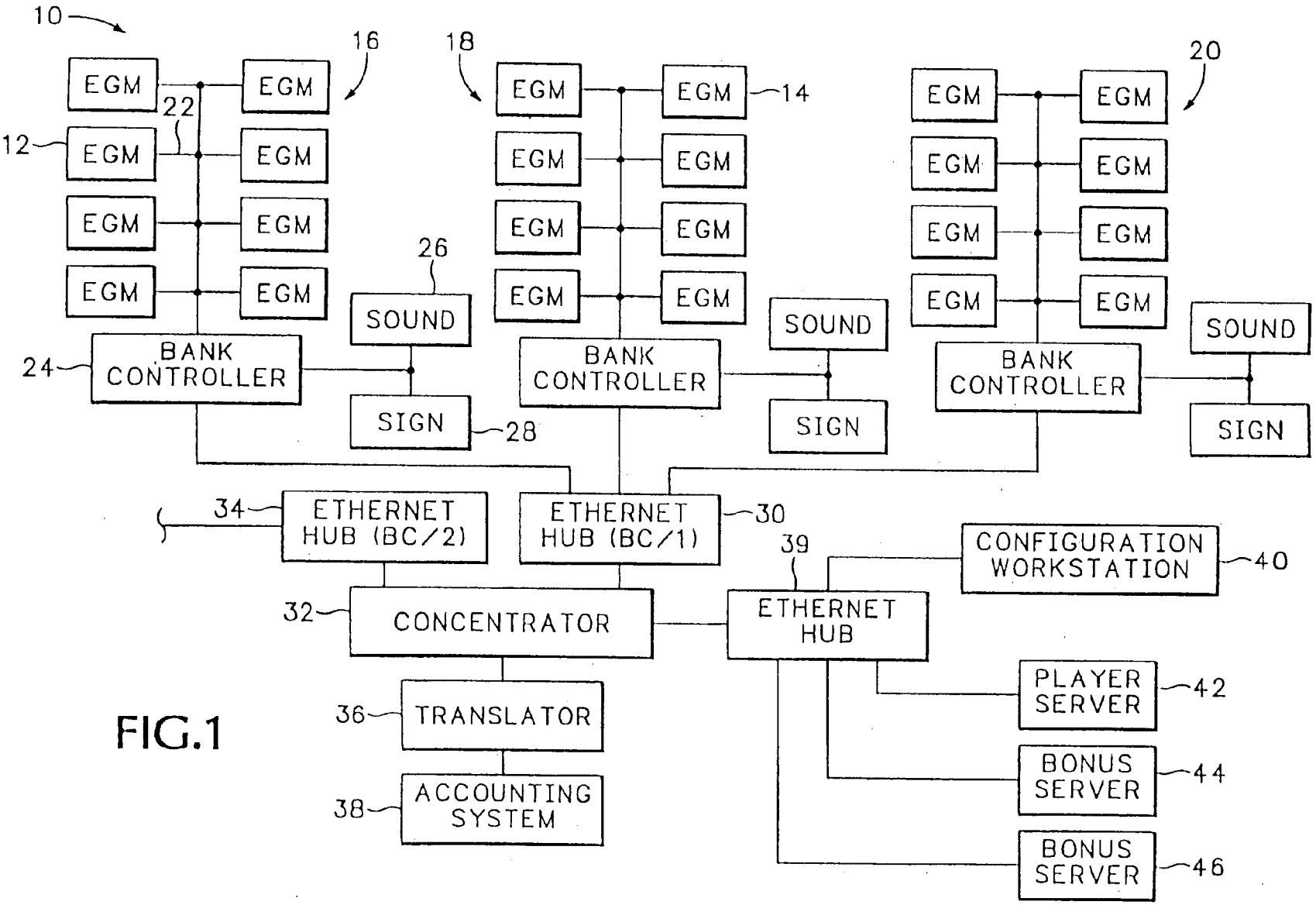
FIG. 1 is a schematic diagram of a plurality of electronic gaming machines interconnected by a computer network to a host computer in accordance with a networked embodiment of the present invention.

Turning now to FIG. 1, indicated generally at 10 is a schematic diagram illustrating electronic gaining machines (EGMs), like EGMs 12, 14, interconnected by a computer network. Included therein are three banks, indicated generally at 16, 18, 20, of EGMs. Each EGM is connected via a network connection, like connection 22, to a bank controller 24. In the present embodiment of the invention, each bank controller comprises a processor that facilitates data communication between the EGMs in its associated bank and the other components on the network. The bank controller also includes a CD ROM drive for transmitting digitized sound effects, such as music and the like, to a speaker 26 responsive to commands issued over the network to bank controller 24. The bank controller is also connected to an electronic sign 28 that displays information, such as jackpot amounts and the like, visible to players of machines on bank 16. Such displays are generated and changed responsive to commands issued over the network to bank controller 24. Each of the other banks 18, 20 of EGMs include associated bank controllers, speakers, and signs as shown, which operate in substantially the same manner.

Ethernet hub 30 connects each of the bank controllers associated with banks 16, 18, 20 of EGMs to a concentrator 32. Another Ethernet hub 34 connects similar bank controllers (not shown), each associated with an additional bank of EGMs (also not shown), to concentrator 32. The concentrator functions as a data control switch to route data from each of the banks to a translator 36. The translator comprises a compatibility buffer between the concentrator and a proprietary accounting system 38. It functions to place all the data gathered from each of the bank controllers into a format compatible with accounting system 38. The present embodiment of the invention, translator 38 comprises an Intel Pentium 200 MHz Processor operating Microsoft Windows NT 4.0.

Another Ethernet hub 39 is connected to a configuration workstation 40, a player server 42, and to bonus servers 44, 46. Hub 39 facilitates data flow to or from workstation 40 and servers 42, 44, 46.

The configuration workstation 40 comprises a personal computer including a keyboard, Intel Pentium Processor, and Ethernet card. It is the primary user interface with the network.

The player server 42 comprises a microcomputer that is used to control messages that appear on displays associated with each EGM. Player server 42 includes an Intel Pentium Processor and an Ethernet card.

Bonus servers 44, 46 each comprise a microcomputer used to control bonus applications on the network. Each bonus application comprises a set of rules for awarding jackpots in excess of those established by the pay tables on each EGM. For example, some bonus awards may be made randomly, while others may be made to linked groups of EGMs operating in a progressive jackpot mode. Examples of bonuses that can be implemented on the network are disclosed in a co-pending application, now U.S. Pat. No. 6,319,125 (the '125 patent), which is incorporated herein by reference for all purposes. This co-pending patent also describes in more detail features of the network, like that shown in FIG. 1, that may be used to implement the present invention. The '961 patent also discloses bonuses that can be implemented by bonus servers 44, 46 and a network that could be used to implement the present invention.

As used herein the term jackpot indicates an award made resulting from the pay table on one of the EGMs while the term bonus indicates an award that does not result from the machine's pay table. The '125 patent and '961 patent include many examples of bonuses. The term award is intended to encompass any payment given to a player of one of the EGM's and includes both jackpots and bonuses.

Figure 2:
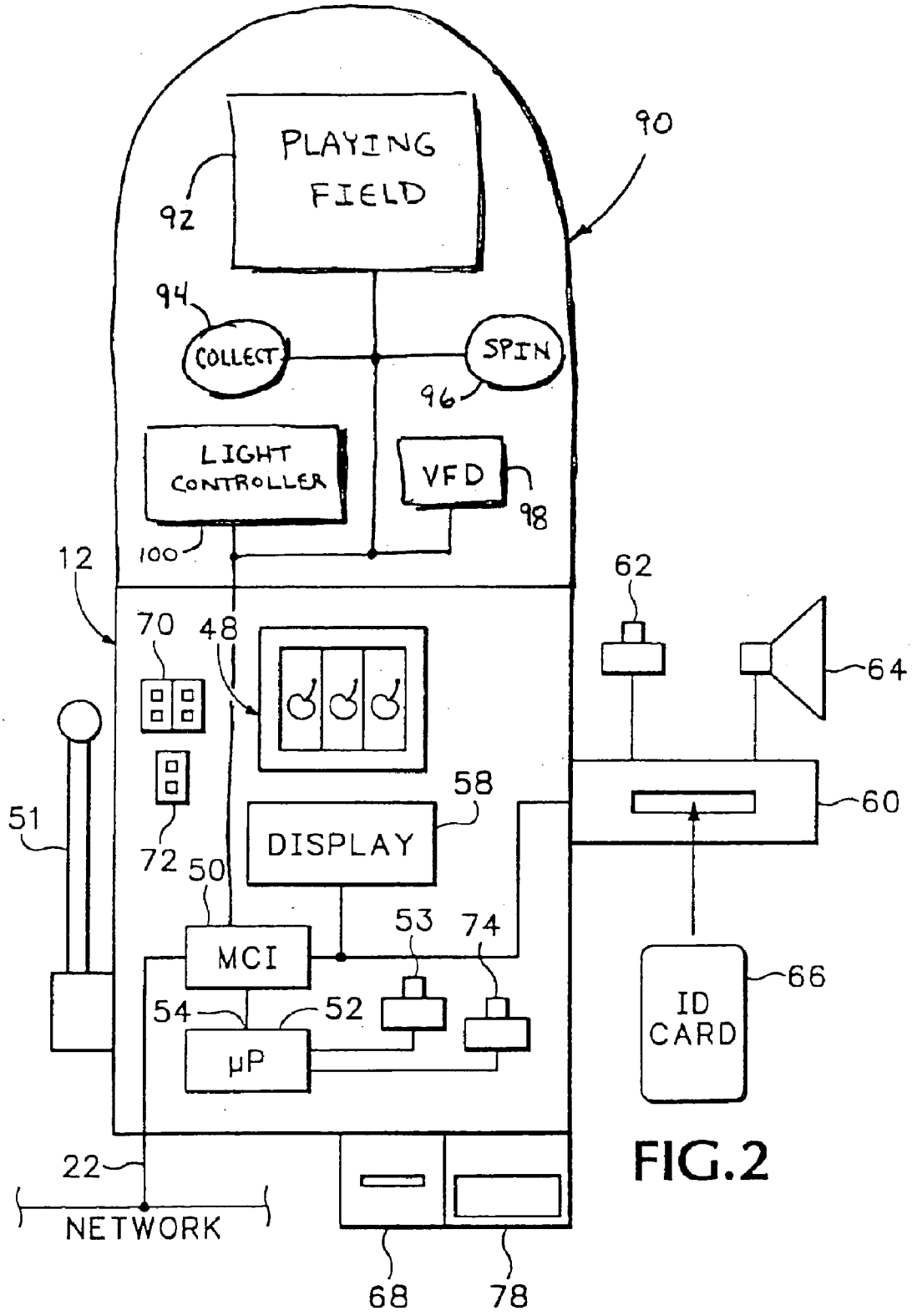
FIG. 2 is a schematic diagram of a slot machine and associated hardware, including the top box secondary game constructed in accordance with a preferred embodiment of the invention.

FIG. 2 illustrates a gaming machine 12 constructed according to a preferred embodiment of the invention. Included is a highly schematic representation of an electronic slot machine—typical of each of the machines in the network—that incorporates network communications hardware as described hereinafter. This hardware is described in the '961 patent, and is referred to therein as a data communications node. Preferably the network communications hardware is like that disclosed in the '125 patent, namely a machine communication interface (MCI) 50.

MCI 50 facilitates communication between the network, via connection 22, and microprocessor 52, which controls the operation of EGM 12. This communication occurs via a serial port 54 on the microprocessor to which MCI 50 is connected.

Included in EGM 12 are three reels, indicated generally at 48. Each reel includes a plurality of different symbols thereon. The reels spin in response to a pull on handle 51 or actuation of a spin button 53 after a wager is made. One or all of the reels 48 may include a special bonus initiator symbol which, when obtained on the gaming machine's payline, will cause the MCI 50 to initiate the secondary bonus game, which is operated according to methods discussed further below.

MCI 50 includes a random access memory (RAM), which can be used as later described herein. The MCI also facilitates communication between the network and a vacuum florescent display (VFD) 58, a card reader 60, a player-actuated push button 62, and a speaker 64.

Before describing play according to the invention, description will first be made of typical play on a slot machine, like EGM 12. A player plays EGM 12 by placing a wager and then pulling handle 51 or depressing spin button 53. The wager may be placed by inserting a bill into a bill acceptor 68. A typical slot machine, like EGM 12, includes a coin acceptor 80 (FIG. 3) that may also be used by the player to make a wager. A credit meter 70 is a numeric display that indicates the total number of credits available for the player to wager. The credits are in the base denomination of the machine. For example, in a nickel slot machine, when a five-dollar bill is inserted into bill acceptor 68, a credit of 100 appears on credit meter 70. To place a wager, the player depresses a coin-in button 82 (FIG. 3), which transfers a credit from the credit meter 70 to a coin-in meter 72. Each time the button is depressed a single credit transfers to the coin-in meter up to a maximum bet that can be placed on a single play of the machine. In addition, a maximum-bet button 84 (FIG. 3) may be provided to immediately transfer the maximum number of credits that can be wagered on a single play from the credit meter 70 to the coin-in meter 72.

When coin-in meter 72 reflects the number of credits that the player intends to wager, the player depresses spin button 53 thereby initiating the base game.

The player may choose to have any jackpot won applied to credit meter 70. When the player wishes to cash out, the player depresses a cash-out button 74, which causes the credits on meter 70 to be paid in coins to the player at a hopper 78, which is part of machine 12. The machine consequently pays to the player, via hopper 78, the number of coins—in the base denomination of the machine—that appear on credit meter 70.

Card reader 60 reads a player-tracking card 66 that is issued by the casino to individual players who choose to have such a card. Card reader 60 and player-tracking card 66 are known in the art, as are player-tracking systems, examples being disclosed in the '961 patent and '125 patent. Briefly summarizing such a system, a player registers with the casino prior to commencing gaming. The casino issues a unique player-tracking card to the player and opens a corresponding player account that is stored on accounting system 38 (in FIG. 1). Accounting system 38 is referred to herein as a host computer. It should be appreciated, however, that the host computer can be distributed on the network and could include multiple processors or memories. The account includes the player's name and mailing address and perhaps other information of interest to the casino in connection with marketing efforts. Prior to playing one of the EGMs in FIG. 1, the player inserts card 66 into reader 60 thus permitting accounting system 38 to track player activity, such as amounts wagered and won and rate of play.

To induce the player to use the card, the casino awards each player points proportional to the money wagered by the player. Players consequently accrue points at a rate related to the amount wagered. The points are displayed on display 58. In prior art player tracking systems, the player may take his or her card to a special desk in the casino where a casino employee scans the card to determine how many accrued points are in the player's account. The player may then redeem points for selected merchandise, meals in casino restaurants, or the like, which each have assigned point values.

The electronic gaming machine 12 constructed according to a preferred embodiment of the invention includes a Bally S5500/S6000 upright slot machine, which is the base game, with the top box removed. The top box is replaced with a top box 90 customized to implement a secondary, bonus game according the present invention. The top box 90 includes a display playing field 92, a pair of buttons, including collect button 94 and bonus game spin button 96, and a VFD 98 intended to display the bonus credits accumulated by playing the secondary bonus game. The top box also includes a bonus and light controller 100 that interfaces with MCI 50 to drive the light display pattern of the top box 90 in attract mode and bonus play mode.

Figure 3:
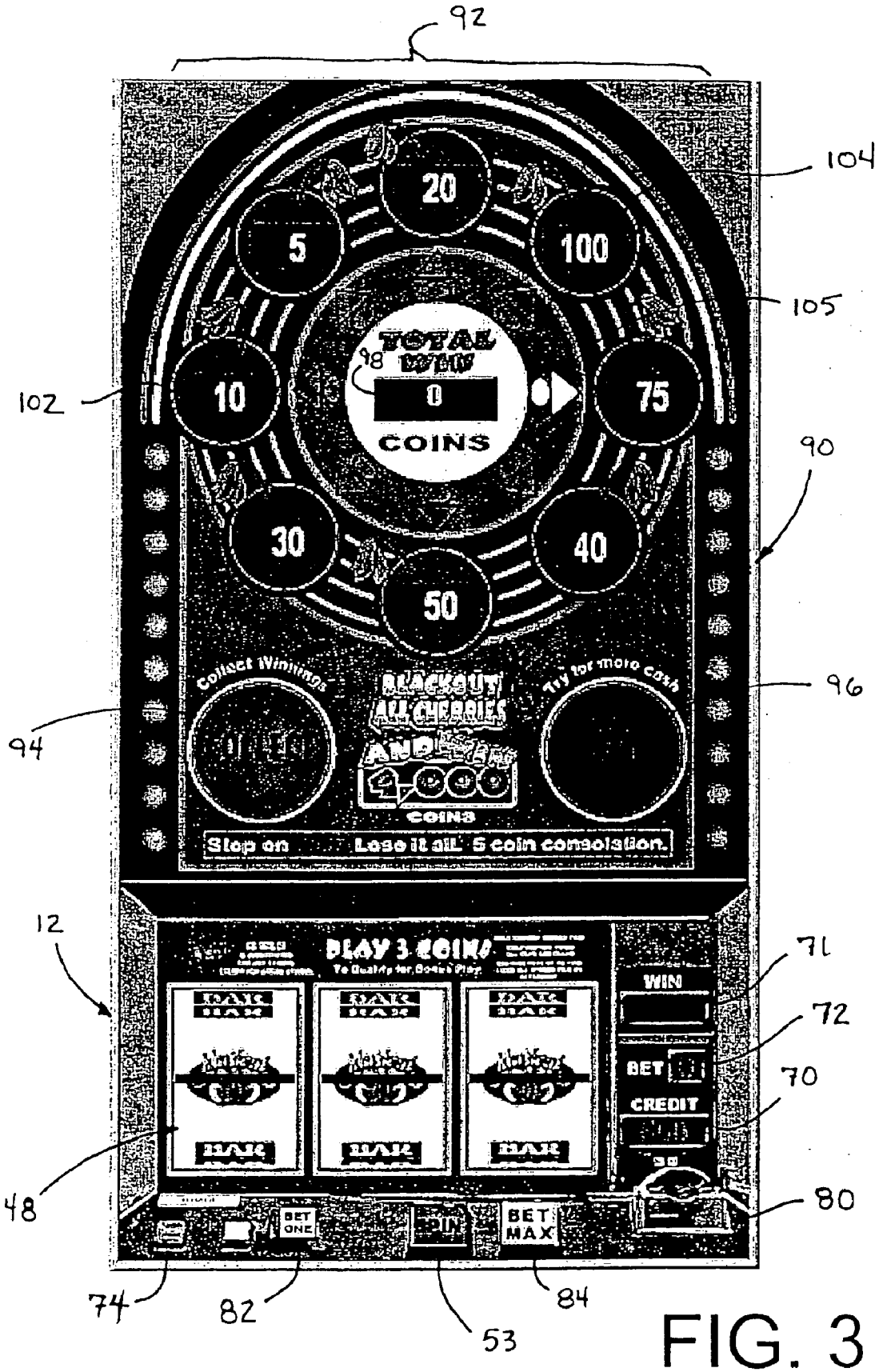
FIG. 3 is a pictorial view of the top box playing field displaying the secondary game implemented using the apparatus shown in FIG. 2.

A more pictorial view of the electronic gaming machine 12 with top box 90 is shown in FIG. 3. The playing field 92 includes eight predesignated positions, such as cherries 102, 104, each having a different numerical value associated with it. A spinner/pointer 105 rotates circularly around the playing field until it stops at one of the eight predesignated positions and points to the particular selected cherry.

Figure 5:
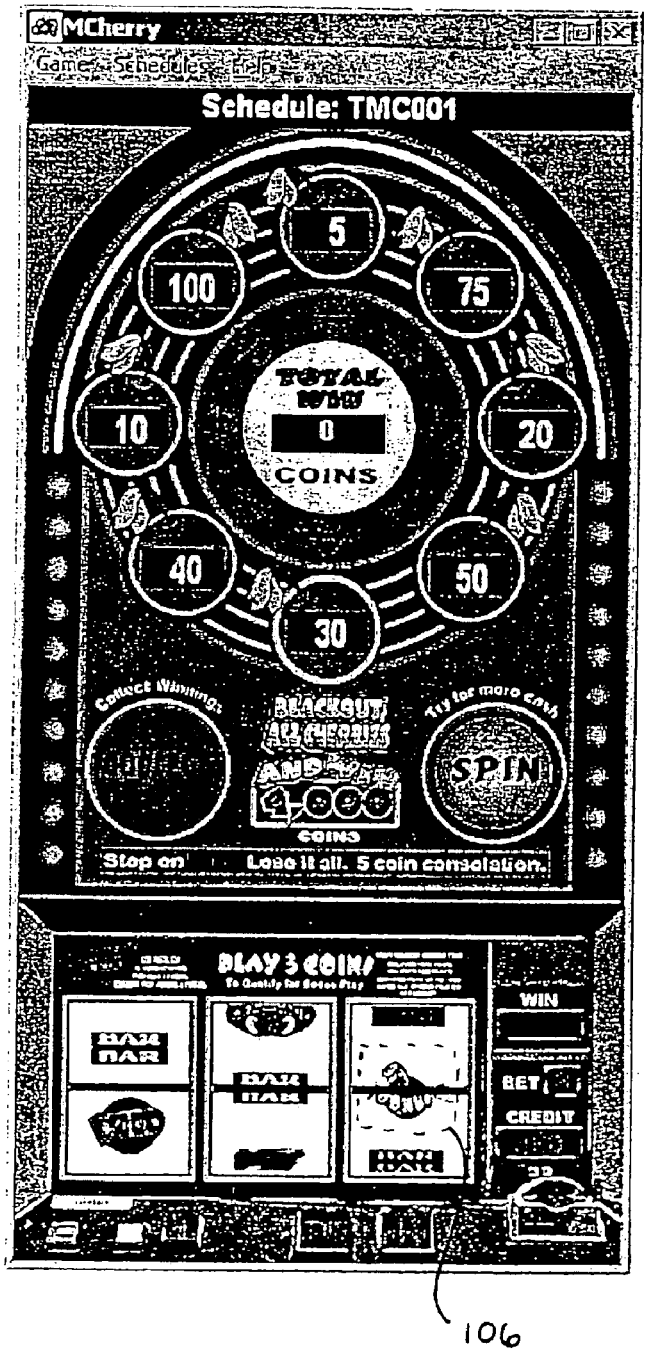
FIGS. 5–11 are secondary top box displays illustrating an exemplary secondary game sequence implemented according to the method shown in FIG. 4.

In operation, when a special symbol appears on one of the base-game reels (such as the bonus cherry symbol 106 shown in FIG. 5), the secondary game is initiated. After the special symbol 106 is detected, the bonus game controller 100 is instructed to perform two main tasks: (1) positioning each of eight predetermined bonus values at selected ones of the cherry spaces 102, 104 so that each space is initially associated with a different numerical value, and (2) building an eight phase bonus script by randomly preselecting eight successive spin results so that the controller (but not the player) knows in advance which cherry space the spinner will stop on in successive phases of the bonus game. The script can include multiple selections of the same position. Accordingly, as will be appreciated below, a "super bonus award" can only be won if the randomly generated script has no repeated spaces and the player ops to stay in for all phases.

When the bonus game begins, the player is prompted to hit the spin button 96 thereby causing the lamps behind each spinner position 102, 104 to light in sequence until the sequence stops and the spinner 105 points at the selected cherry. The numerical value associated with the selected cherry is accumulated in a memory and visually tracked in the bonus display 98 located on the set top box. The selected cherry is then transformed into a "bust" spot. Hitting a "bust" spot in any successive phase of the bonus game results in a loss of the bonus award tracked in the display 98 and, alternately, an award of a consolation prize. Rather than risk this result, the player can opt out after this first phase by pressing the collect button 94 and claim the award thereby causing the bonus amount stored in memory to be transferred to the credit meter of the base game.

Alternately, the player can continue on to the second phase by again pressing the spin button 96 in the hopes of obtaining a non-"bust" space and thereby accumulating additional credits in the bonus display in an amount associated with the second selected cherry. A second successful spin results in a second "bust" spot. Thus, each successive phase of the bonus game carries increased risk since there are more "bust" spots.

Table 1, below and on the left, illustrates an association of each bonus cherry spaces with a numerical awards. Here, the eight bonus cherry spaces 102, 104 correspond to the letters A through H with associated bonus credit values. Table 2, below and on the right, illustrates a pre-generated bonus script showing the payout schedule of the bonus game based upon the number of times the player presses the spin button prior to opting out of the bonus game. That is, the player would be awarded 75 credits for opting out after the first phase (i.e. immediately after hitting the 'A' space) but would be awarded 160 accumulated credits if the player were to opt out (e.g. hit the collect button 94) after the fourth phase. Note that the fifth phase results in a repeated result (the 'E' space), which would have been converted to a "bust" spot after the second phase. Accordingly, the player would have lost his accumulated credits and instead been awarded a consolation prize of 15 credits. Since the bonus round ends after a bust spot is obtained, further spins (e.g. $6^{th}$ through $8^{th}$) are not possible according to this particular pre-generated secondary game bonus script.

TABLE 1

| SPACE | Bonus Credits |
|---|---|
| A | 75 |
| B | 40 |
| C | 30 |
| D | 100 |
| E | 50 |

TABLE 1-continued

| SPACE | Bonus Credits |
|---|---|
| F | 30 |
| G | 10 |
| H | 5 |

TABLE 2

| SPIN # | Selected Space | Credit Awarded |
|---|---|---|
| 1 | A | 75 |
| 2 | E | 125 |
| 3 | F | 155 |
| 4 | H | 160 |
| 5 | E | 15 |
| 6 | C | — |
| 7 | A | — |
| 8 | B | — |

Consolation amounts are determined based on the spins tracked by the counter. A bust result occurring in the second through eighth phases results in consolation awards in the following respective amounts: 3, 6, 9, 15, 25, 100 and 300. No bust result is possible in the first phase since there are no "bust" spaces until after the first spin. A super bonus amount of 4000 credits is awarded to the player on top of the 340 accumulated credits if the player makes it through all eight phases without hitting a "bust" spot. This only occurs if the bonus script includes no repeated spaces and the player stays in for all phases.

Figure 4:
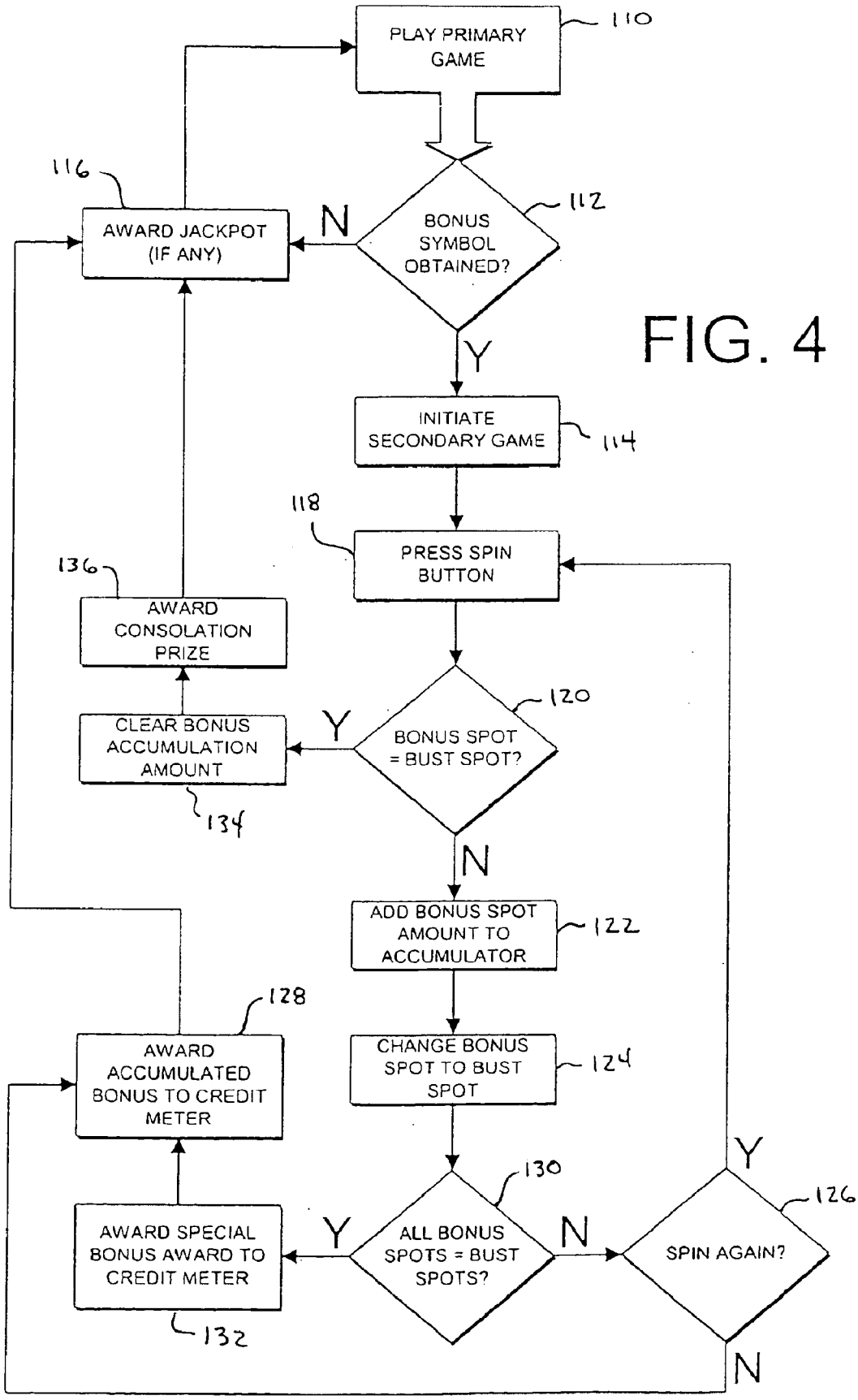
FIG. 4 is a flow chart that depicts the operation of the FIG. 3 secondary game in accordance with the present invention.

FIG. 4 is a flow diagram showing the operation of a preferred embodiment of the game practiced according to the invention. The underlying concept behind the game of the present invention, therefore, involves player decision making and input—that is, whether the player should press his or her luck for potentially increased payout where the chance of continuing with the secondary game becomes increasingly risky as safe payout spaces are converted to bust spaces. The player is thus given the opportunity to collect the accumulated bonus or risk losing all but a consolation prize by further play of the bonus game.

Play is commenced at the primary base game in block 110. In the slots embodiment shown, a player inserts coins into coin slot 80 or plays accumulated credits from a player credit account and presses the spin button 53 or pulls the slot machine handle 51 to start the turn of the three reels 48. If a bonus initiator symbol is obtained (FIG. 5) in block 112, then the method proceeds to block 114 in which the bonus game is initiated. It is also contemplated that the player must qualify in order to be eligible to proceed to block 114. Examples include: played max coin, is playing at a particular rate, the identity of the player, etc.

If no bonus initiator symbol is obtained, then the method proceeds to block 1116 where any jackpot obtained by play of the base game three reels according to a pay table stored in the gaming machine is awarded to the player. Play of the primary game then commences in block 110.

Figure 6:
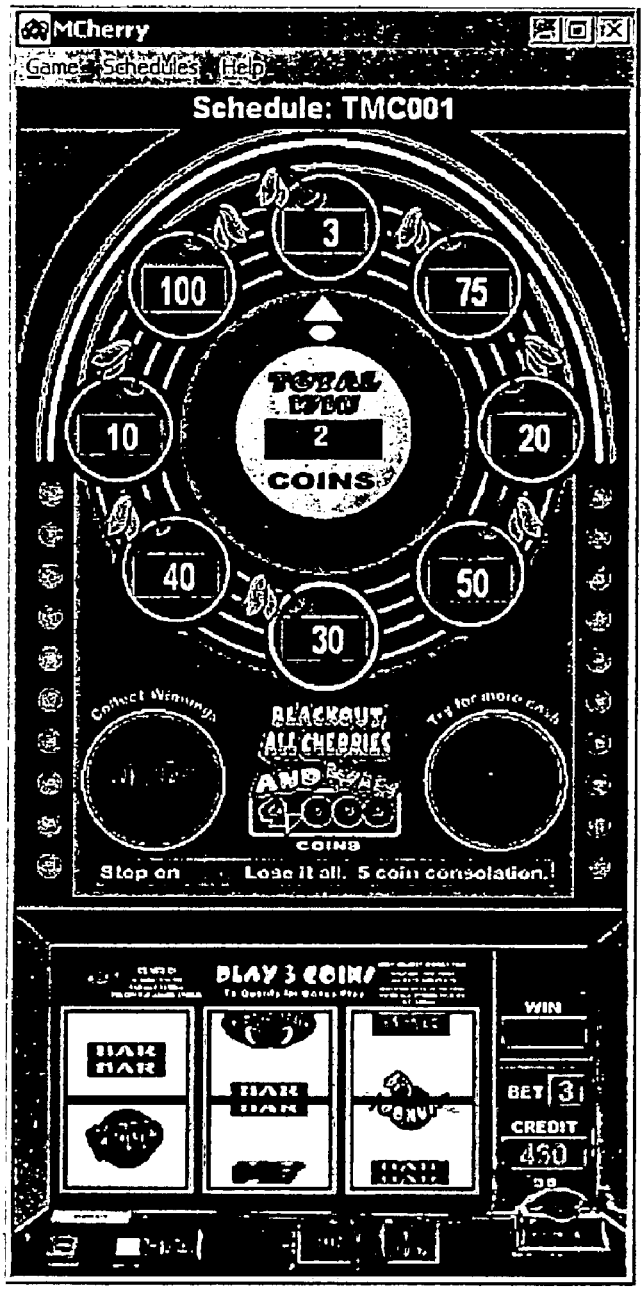

At initiation of the secondary game in block 114, the MCI 50 instructs the light controller 100 to light all cherries in the playing field and to flash the spin button. The player starts the secondary game by pressing the spin button in block 118, which in turn sends a signal to the MCI 50 and thence to light controller 100 to sequentially light the spinner lights to give the spinner 105 the illusion of pointing to successive cherries. A calculation is made within the secondary game paytable stored in MCI 50 to select one of the eight cherry spots and thus determine the ending position of the spinner 105 (FIG. 6).

In block 120, a detection is made whether the selected ending position of the spinner points to a bonus spot having a numerical value or a bust spot. Under the preferred secondary game contemplated by the invention, all bonus cherry values are available during this first spin and there are no "bust" cherry spots. The method then proceeds through detection block 120 to block 122 in which the numerical value of the spot is accumulated and displayed within the bonus credit VFD display 98. In FIG. 6, for instance, the spinner landed on the cherry spot corresponding to a numerical value of five, and thus five credits (the two already accumulated within the display and the three still in the spot) are accumulated.

Figure 7:
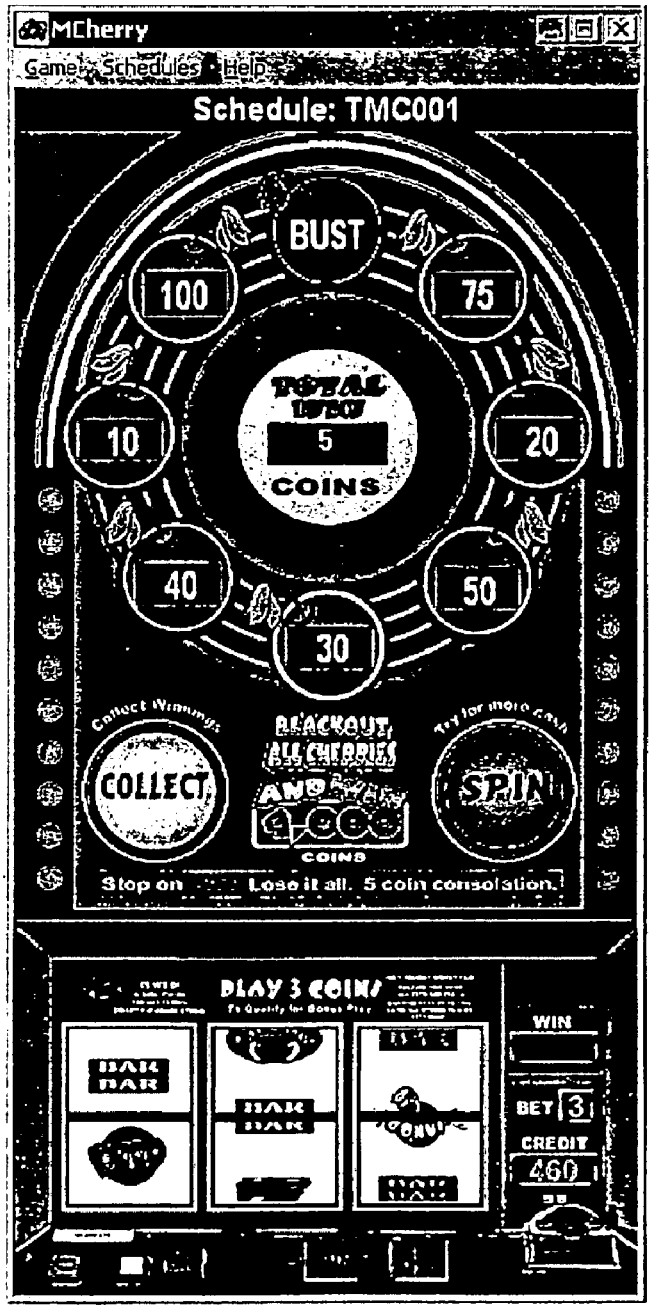

The selected cherry spot is then changed from a bonus spot to a "bust spot" in block 124, the significance of which will be discussed further below. FIG. 7 illustrates the step in the secondary game after the first bonus has been accumulated in the central display, the bonus spot changed to a bust spot, and the collect button lighted and the spin button flashed. The player is then faced with a choice in block 126 of cashing out the accumulated bonus or proceeding with the secondary bonus game and spinning again, thus risking the accumulated bonus on the chance that the player hits the bust spot on his second spin.

If the player chooses to cash out, then the method proceeds to block 128 where the accumulated bonus shown in display 98 is awarded to the machine win meter 71 (FIG. 3) and thence to the player credit meter 70. Any jackpot award from the primary game is awarded in block 116 to the player and the player continues playing the primary game in block 110.

Figure 8:
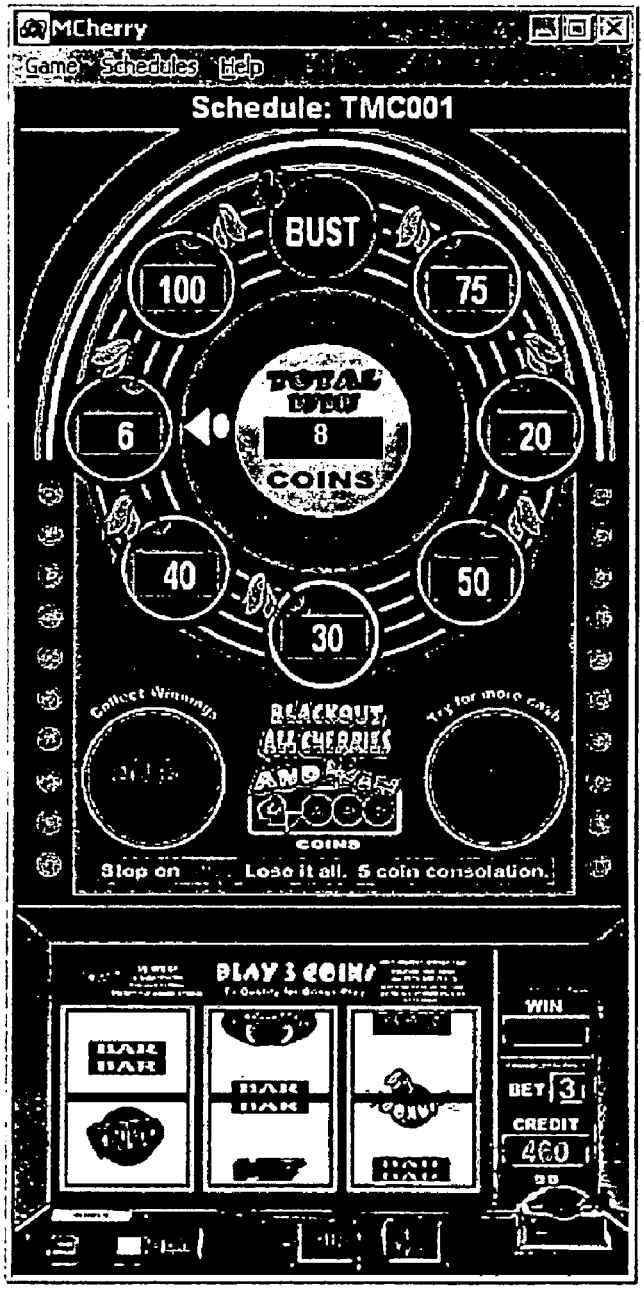

If the player chooses to spin again in block 126, then the player presses the flashing spin button 96 in block 118 to initiate the second spin. The spinner 105 lands on a second bonus cherry space (FIG. 8) good for ten coins which are accumulated in block 122 to the five already in the bonus display window 98 for a total of fifteen. The second selected spot is then changed to a second bust spot in block 124.

At this point, a detection is made in block 130 as to whether all bonus spots have been obtained (e.g. whether all bonus spots have been converted to bust spots). If this is true, then the player is awarded a special bonus award in block 132 of four thousand credits to the machine win meter 71 and player credit meter 70. Such a prize is typically large because, as will be appreciated below, the player has an increasing chance of hitting a bust cherry and thus ending the bonus period before all bonus cherries have been obtained. The large special bonus award encourages players to press their luck.

Figure 9:
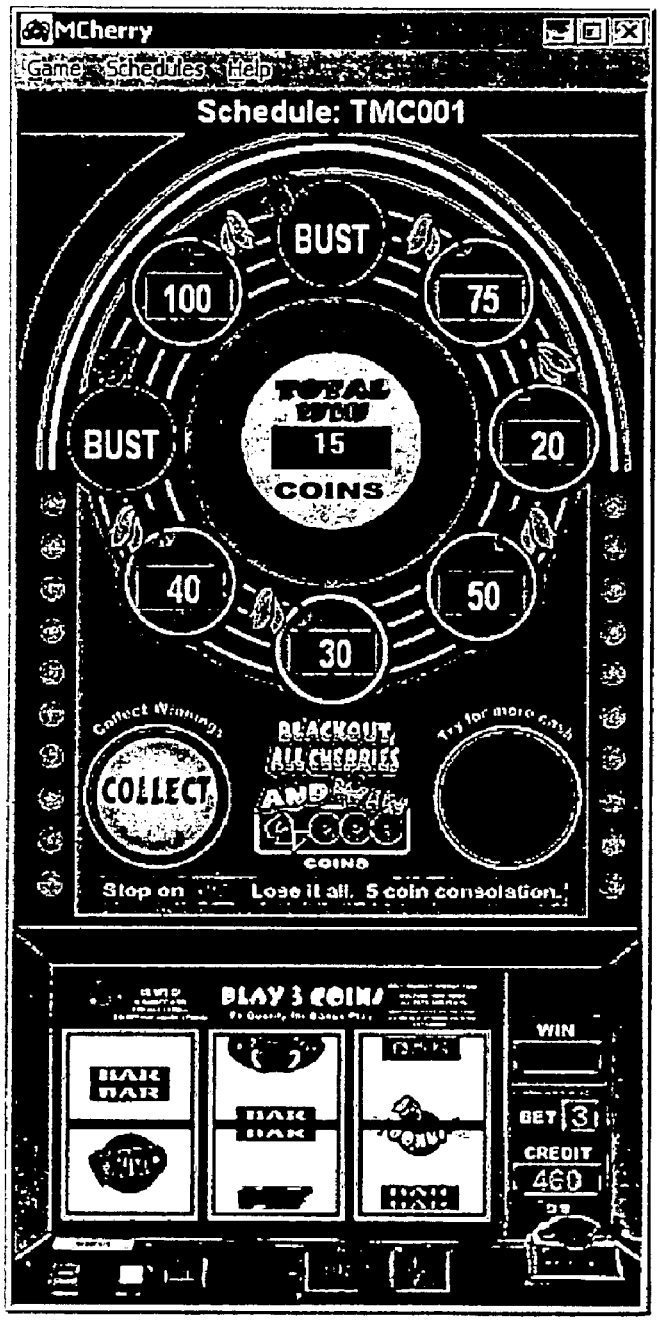
Figure 10:
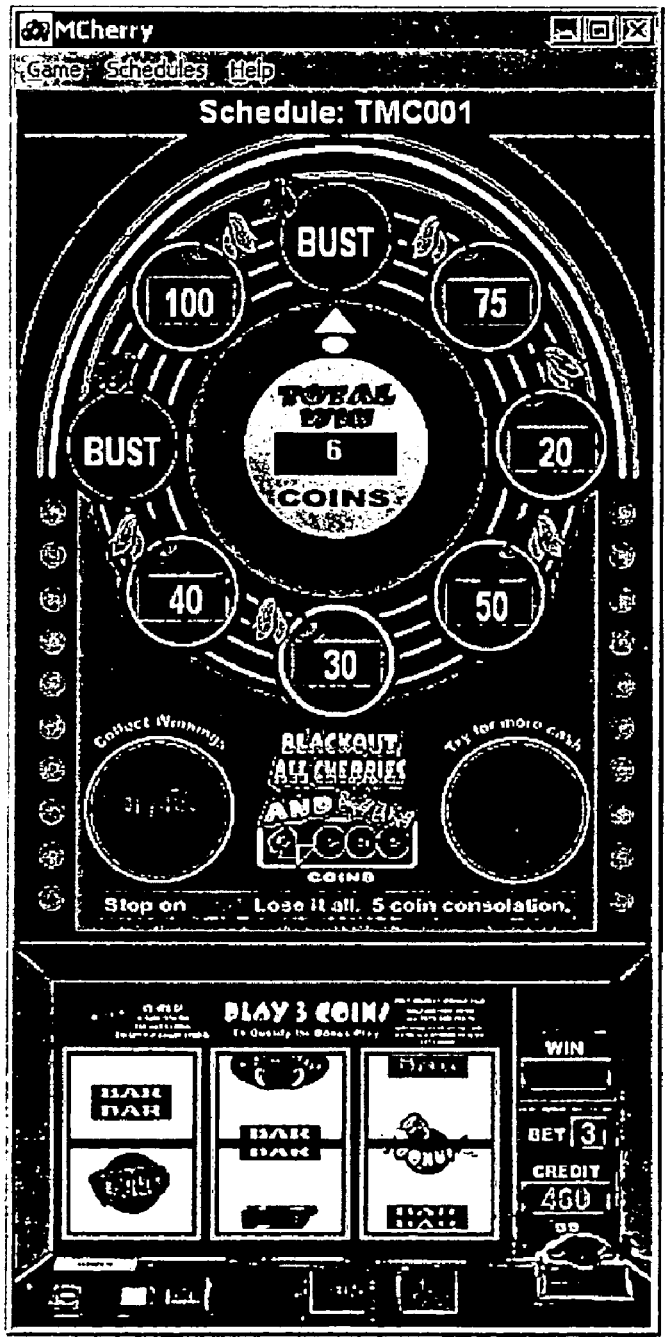
Figure 11:
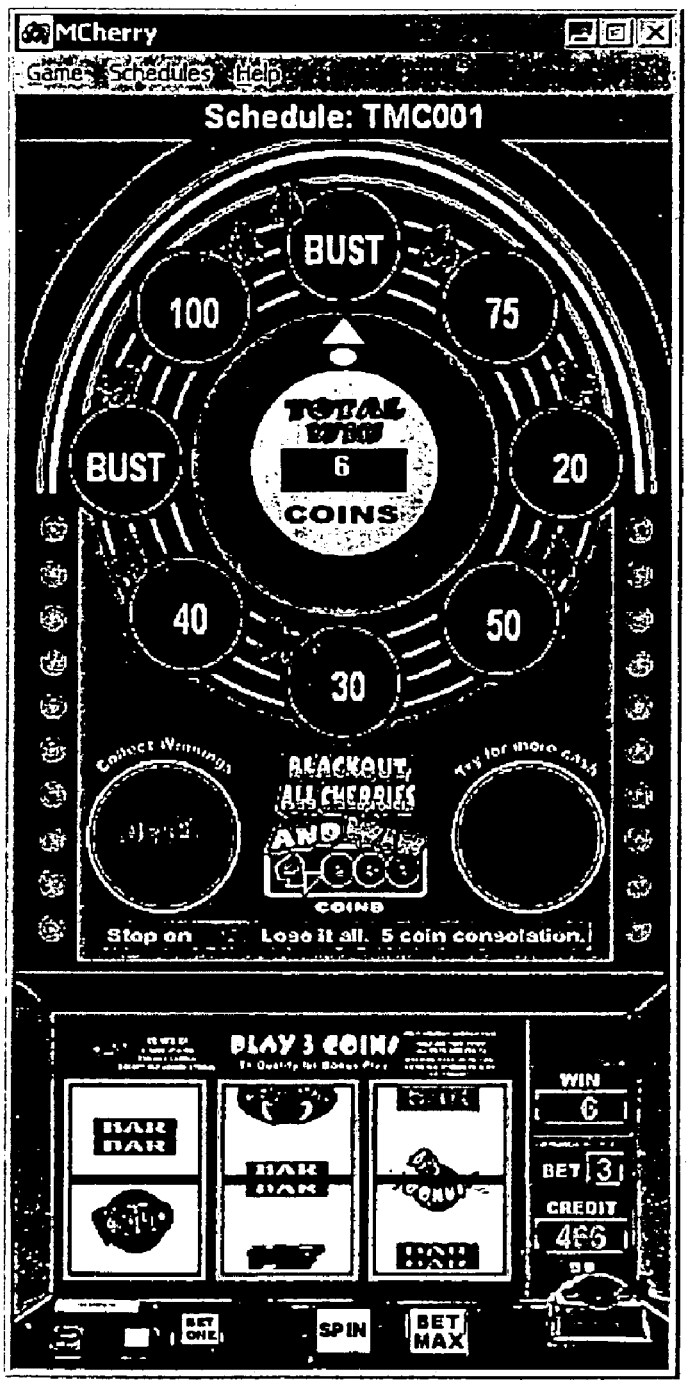

If not all of the bonus spots have been obtained, then the method proceeds to block 126 which again asks whether the player would like to continue pressing his or her luck or collect the accumulated winnings (FIG. 9). In the example chosen, the player chooses to proceed to block 118 and spin again, this for a third time. Unfortunately, the player lands on a bust spot (FIG. 10), which in this case was the first bonus spot the player obtained. The bust spot detection in block 120 causes the MCI 50 to clear the accumulation amount in block 134 and instead award a consolation prize in block 136. Here, the consolation prize is calculated at three credits for every bust cherry, or six credits total, which are reflected in the bonus display 98. The bonus and any jackpot are awarded to the machine credit meter 71 (FIG. 11) and thence to the player credit meter 70 in block 116. Regular play on the primary base game then commences in block 110. Subsequent bonus games are initiated with all bonus cherries available and no bust cherries shown.

Having described and illustrated the principles of the invention in a preferred embodiment thereof, it should be apparent that the invention can be modified in arrangement and detail without departing from such principles. I claim all modifications and variation coming within the spirit and scope of the following claims.

What is claimed is:

1. A method for operating a gaming machine under control of a processor operable in a bonus mode, the method comprising the steps of:

setting up under control of the processor a bonus game by defining a plurality of selection elements;

assigning various bonus game outcomes to the selection elements;

selecting one or more of the selection elements in the bonus mode and, after each selection, associating an end-bonus penalty to the selection element if subsequently selected thereby increasing an apparent probability of obtaining an end-bonus penalty in the bonus game after each selection;

determining under control of the processor a value of the selection elements selected in the bonus game;

ending the bonus game upon selection of a selection element associated with the end-bonus penalty; and ending the bonus game, prior to selection of an end-bonus penalty, upon a user-initiated collection request and awarding a bonus credit based on the value of the selection elements selected.

2. The method of claim 1, further including the step of awarding a consolation prize in place of the bonus credit if an end-bonus penalty is selected during the bonus game.

3. The method of claim 1 wherein the step of assigning various bonus game outcomes to the selection element comprises:

assigning upon setup of the bonus game a payoff value to each selection element.

4. The method of claim 3, wherein the step of determining the value of the selection elements selected in the bonus game comprises summing the payoff values of the selection elements selected.

5. The method of claim 3, wherein the gaming machine includes a display, the method of operating the gaming machine further comprising the steps of;

displaying end-bonus identifier symbols on selection elements associated with an end-bonus penalty; and displaying payoff value identifier symbols on selection elements not associated with an end-bonus penalty.

6. The method of claim 5, further comprising the steps of:

displaying a pointer animation scrolling through one or more of the selection elements during each trial of the bonus game; and stopping the pointer animation adjacent to the selected selection element, a successful trial being characterized by stopping the pointer animation adjacent to a selection element associated with a payoff value identifier symbol, an unsuccessful trial being characterized by stopping the pointer animation adjacent to a selection element associated with an end bonus identifier symbol.

7. The method of claim 1, further including the step of generating a script prior to the step of selecting the selection elements, said script predetermining the order and selection of the selection elements.

8. The method of claim 7, wherein the script includes a repeat selection of one of the selection elements.

9. The method of claim 7, wherein the script does not include a repeat selection of any of the selection elements, said method further including the step of awarding a supplemental bonus at the end of the bonus game unless a collection request is detected during the bonus game.

10. The method of claim 1 wherein the gaming machine includes a spin button and a collect button, the method further including the steps of:

suspending the bonus game after each successful trial of the bonus game; and awarding the bonus credit responsive to user-selection of the collect button or continuing the bonus game responsive to user-selection of the spin button.

11. A method of operating a gaming machine under control of a processor operable in a basic mode and a bonus mode, the method comprising the steps of:

selecting under control of the processor in said basic mode a basic game outcome among a plurality of possible basic game outcomes, the possible basic game outcomes including a start-bonus outcome;

shifting operation of the processor from said basic mode to the bonus mode in response to the selection of the start-bonus outcome, otherwise, continuing operation of the processor in the basic mode;

setting up under control of the processor a bonus game by defining a plurality of selection elements;

assigning various bonus game outcomes to the selection elements including valued elements and end-bonus penalty elements;

selecting one or more of the selection elements in the bonus mode and increasing the apparent probability of selecting an end-bonus penalty element after each selection;

determining under control of the processor a value of the selection elements selected in the bonus game; and ending the bonus game upon selection of a selection element associated with the end-bonus penalty; and ending the bonus game, prior to selection of an end-bonus penalty, upon a user-initiated collection request and awarding a bonus credit based on the value of the selection elements selected.

12. The method of claim 11 wherein the basic game comprises a slot machine including a number of reels each including a plurality of displayable symbols, the step of selecting a basic game outcome comprising the steps of:

randomly selecting a combination of said symbols; and displaying said combination of symbols.

13. The method of claim 12, wherein the start-bonus outcome is characterized by the display of a designated start-bonus game symbol on each of the reels.

14. The method of claim 11, further including the steps of:

generating a script prior to the step of selecting the selection elements, said script predetermining the order and selection of the selection elements; and executing the script during the step of selecting the selection elements.

15. The method of claim 14, further including the step of allowing user choice to end the bonus game prior to the full execution of the bonus script and returning the gaming machine to the basic mode.

16. A gaming machine comprising:

a processor for controlling game play in a bonus mode, the processor operating in a bonus mode to set up a bonus game by defining a plurality of selection elements;

means for assigning under control of the processor various bonus game outcomes to the selection elements;

means for selecting one or more of the selection elements in the bonus mode and, after each selection, associating an end-bonus penalty to the selection element if subsequently selected thereby increasing an apparent probability of obtaining an end-bonus penalty in the bonus game after each selection;

valuation means for determining under control of the processor a value of the selection elements selected in the bonus game;

user input means at the gaming machine for ending the bonus game before obtaining an end-bonus penalty; and bonus credit means for awarding a bonus credit based on said value of the selection elements selected only if not end-bonus penalty is selected during the bonus game.

17. The gaming machine of claim 16 wherein the valuation means includes means for summing the payoff values of the selection elements selected in successful trials of the bonus game.

18. The gaming machine of claim 16, the user input means including a collection button and a spin button active to receive user input after each successful trial, the collection button ending the bonus game and the spin button continuing the bonus game.

19. The gaming machine of claim 16, further including a script generation means for generating upon the start of the bonus mode an order in which the selection elements are selected during the bonus game.

* * * * *

UNITED STATES PATENT AND TRADEMARK OFFICE

CERTIFICATE OF CORRECTION

PATENT NO. : 6,860,811 B1
APPLICATION NO. : 10/120196
DATED : March 1, 2005
INVENTOR(S) : Wilkins It is certified that error appears in the above-identified patent and that said Letters Patent is hereby corrected as shown below:

Column 7,
Line 57, replace “block 1116 where” with -- block 116 where --.

Column 9,
Line 49, replace “steps of;” with -- steps of: --.

Signed and Sealed this

Twenty-seventh Day of June, 2006

JON W. DUDAS
*Director of the United States Patent and Trademark Office*